US005933883A

United States Patent [19]

Biancamano

[11] Patent Number: 5,933,883

[45] Date of Patent: Aug. 10, 1999

[54] POOL STRUCTURE AND FOUNTAIN APPARATUS

[76] Inventor: Vincent Biancamano, 15434 N. 55th Ave., Glendale, Ariz. 85306

[21] Appl. No.: 08/794,932

[22] Filed: Feb. 4, 1997

[51] Int. Cl.[6] ..... E04H 4/00

[52] U.S. Cl. ..... 4/492; 4/496; 239/600

[58] Field of Search ..... 4/492, 496, 507, 4/569, 570, 601; 239/17, 600

[56] References Cited

U.S. PATENT DOCUMENTS

| | | | |
|---|---|---|---|
| 953,529 | 3/1910 | Higgins . | |
| 1,065,265 | 6/1913 | Nordmark | 4/601 |
| 1,403,009 | 1/1922 | Carter . | |
| 1,753,427 | 4/1930 | Phillips | 4/507 |
| 2,166,469 | 7/1939 | Houston | 4/569 |
| 3,030,028 | 4/1962 | Hruby, Jr. . | |
| 3,318,528 | 5/1967 | Williams . | |
| 3,722,816 | 3/1973 | Stewart et al. . | |
| 4,393,526 | 7/1983 | Miller et al. . | |
| 4,449,260 | 5/1984 | Whitaker . | |
| 4,468,822 | 9/1984 | McKay . | |
| 4,554,690 | 11/1985 | Knapp et al. | 4/615 X |
| 4,980,934 | 1/1991 | Dahowski et al. | 4/496 |
| 5,309,581 | 5/1994 | Lockwood et al. | 4/507 X |
| 5,537,696 | 7/1996 | Chartier | 4/569 X |

FOREIGN PATENT DOCUMENTS

| | | | |
|---|---|---|---|
| 0401118 | 12/1990 | European Pat. Off. | 4/601 |

*Primary Examiner*—Charles E. Phillips
*Attorney, Agent, or Firm*—Parsons & Goltry; Michael W. Goltry; Robert A. Parsons

[57] ABSTRACT

A pool structure having a fluid discharge apparatus for conducting water supplied from a pump in a decorative fashion proximate the perimeter of the pool structure.

10 Claims, 6 Drawing Sheets

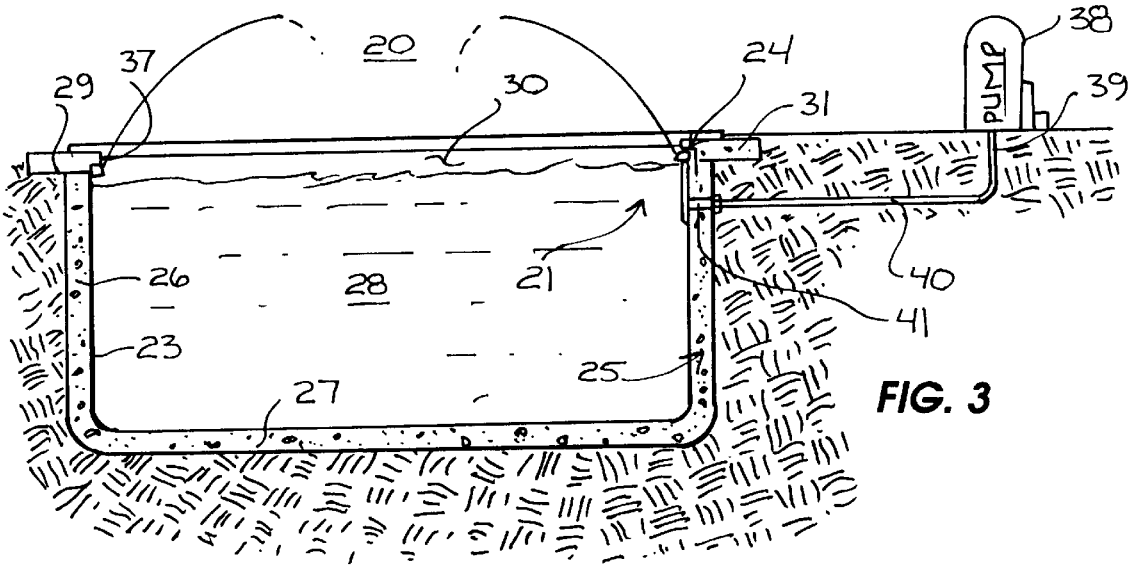
FIG. 3
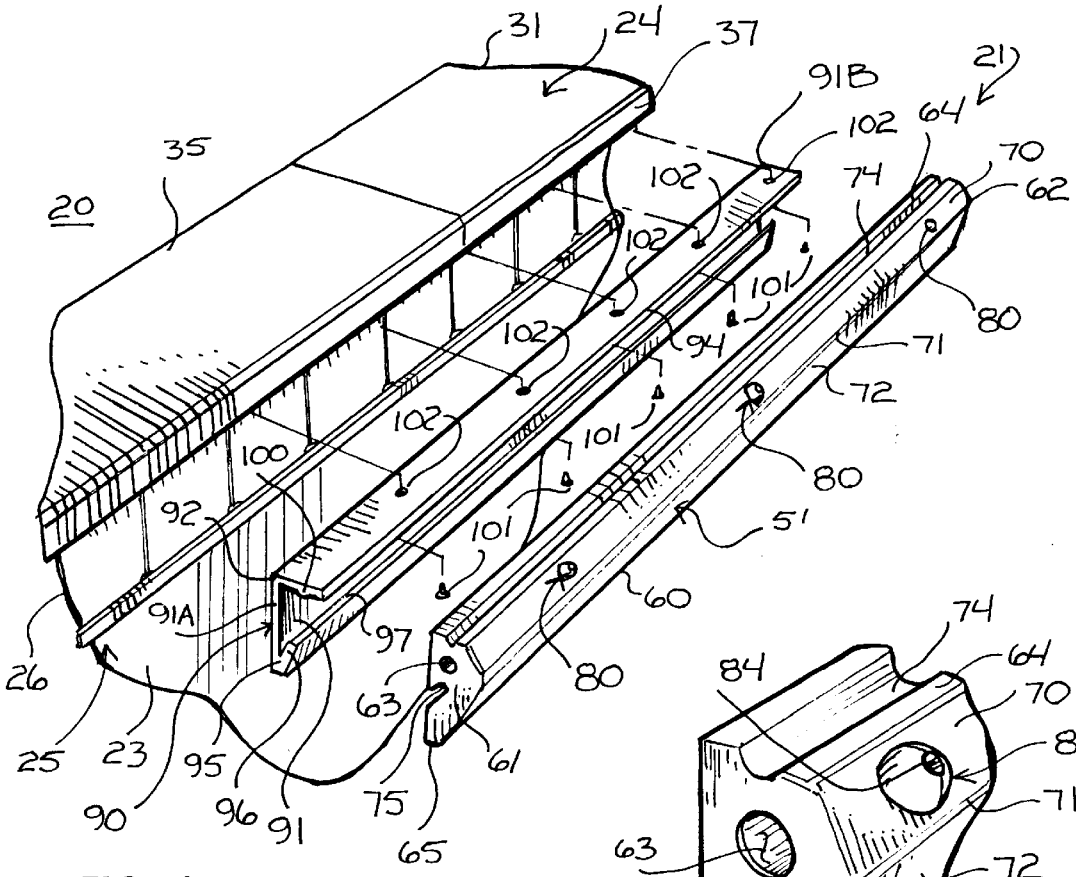
FIG. 4
FIG. 5

200
202
221
222
225
220
204
210
203B
203A
206
223
208
201
203
207
205
226
224
230
230B
211
212
51
83
63

POOL STRUCTURE AND FOUNTAIN APPARATUS

BACKGROUND OF THE INVENTION

1. Field of the Invention

This invention relates generally to the field of fluid discharge apparatus.

More particularly, this invention relates to fluid discharge apparatus for discharging and displaying fluid.

In a further and more specific aspect, the instant invention relates to a pool structure and a fluid discharge apparatus for receiving fluid from a pool structure and discharging and displaying the fluid into the pool structure in a decorative fashion.

2. Prior Art

The incorporation of fountains or fluid discharge and display apparatus in connection with swimming pools, wading pools, ponds and the like is of considerable interest for decorative and artistic purposes. In this regard, a variety of fountain apparatus have been devised for installation and use in combination with swimming pools, wading pools and similar structures operative for enhancing functional and aesthetic characteristics. However, by virtue of considerable research and study, various structural deficiencies inherent with prior art fluid discharge apparatus have created a need not yet addressed by the prior art.

For instance, notable in the prior art is a water fountain that operates in conjunction with a pool water filtering system and which eliminates the necessity for complex plumbing. This device may be either rigidly attached to the water return plumbing of the filtering system or the fountain may be supported by a float and connected to the plumbing by means of a transparent flexible hose or tubing. The height of the spray attachment of the water fountain may be easily adjusted or set and the fountain may readily accommodate a plurality of spray or cap heads as well as accommodate the mounting and supporting of distinctly different abstract sculptures. Although exemplary, the spray attachments of the above described apparatus reside either on top of the water or near the edge of the pool extending upwardly and inwardly toward the water. In either instance, the spray attachments can be dangerous to those wishing to use or swim in the pool when the fountain is in use. As a result, the fountain must be dismantled prior to using the pool which can be frustrating and time consuming.

Other fountain apparatus incorporate aspects for projecting water from a central position and outwardly into a basin or pool structure or from the side of the basin or pool. However, these apparatus, like the foregoing water fountain, require dismantling or removal after use or include mechanical aspects which protrude either from the side of the pool or other positions which can be dangerous to those wishing to use the pool when the fountain is either installed or in use.

It would be highly advantageous, therefore, to remedy the foregoing and other deficiencies inherent in the prior art.

Accordingly, it is an object of the present invention to provide a new and useful pool structure and a fluid discharge apparatus for discharging and displaying fluid in combination with a pool structure such as a swimming pool, wading pool or other similar structure.

Another object of the present invention is to provide pool structure and a fluid discharge apparatus that are easy to construct.

And another object of the present invention is to provide a fluid discharge apparatus that is easy to install.

Still another object of the present invention is to provide a fluid discharge apparatus that is inexpensive.

Yet another object of the instant invention is to provide a fluid discharge apparatus that is easy to use.

Yet still another object of the instant invention is to provide a pool structure and a fluid discharge apparatus that are safe.

And a further object of the invention is the provision of enhancing the beauty of swimming pools, wading pools and similar structures.

Still a further object of the immediate invention is to provide a fluid discharge apparatus for use with a swimming pool or wading pool that does not need to be removed or dismantled for users to safely use the swimming pool or wading pool.

Yet a further object of the invention is to provide a fluid discharge apparatus that may be used for converting a conventional swimming pool, wading pool or other similar structure into a fountain.

And yet a further object of the present invention is to provide a new and useful nozzle assembly for receiving and expelling fluid from a fluid source.

Another object of the present invention is to provide a nozzle assembly that is easy to construct.

And another object of the present invention is to provide a nozzle assembly that is easy to use.

And yet another object of the present invention is to provide a nozzle assembly that may be adjusted for selecting regulating the volume of fluid passing therethrough.

Yet still another object of the present invention is to provide a nozzle assembly that is inexpensive.

Yet still a further object of the present invention is to provide a pool structure and a fluid discharge apparatus operative for cooling the water carried by the pool structure.

Yet another object of the present invention is to provide a pool structure and a fluid discharge apparatus that conserves chemicals by cooling the water carried by the pool structure.

And another object of the present invention is to provide a pool structure and a fluid discharge apparatus that produces pleasing sound effects.

SUMMARY OF THE INVENTION

Briefly, to achieve the desired objects of the instant invention in accordance with a preferred embodiment thereof, provided is a pool structure comprising a basin including a continuous sidewall and a closed bottom cooperating together to bound a chamber. The continuous sidewall further includes an inner surface and extends upwardly from the closed bottom and terminates with a continuous upper edge defining a perimeter bounding an opening to the chamber, and a cornice extending inwardly into the opening proximate the continuous upper edge and terminating with an endwall at a point inboard of the inner surface of the continuous sidewall, thereby creating a concealed region defined by a reentrant angle defined by a lower surface of the cornice and the inner surface of the continuous sidewall proximate the continuous upper edge. Further included is a pump coupled to the basin in fluid communication to recirculate liquid to and from the basin, a liquid return conduit having a first end coupled to the pump and a second end coupled to the basin in fluid communication, the liquid return for delivering liquid from the pump to the basin under pressure and a fluid discharge apparatus coupled to the liquid return conduit in fluid communication and further coupled to the basin within the concealed region and extending along a predetermined length of the perimeter in conformance therewith, the fluid discharge apparatus having a plurality of nozzles disposed in spaced apart relation and for communicating liquid therefrom and to the basin in a decorative fashion.

Further included is a fluid discharge apparatus for a pool structure of a type having a basin including a continuous sidewall and a closed bottom cooperating together to bound a chamber, the continuous sidewall having an inner surface and extending upwardly from the closed bottom and terminating with a continuous upper edge defining a perimeter bounding an opening to the chamber, and a cornice extending inwardly into the opening proximate the continuous upper edge and terminating with an endwall at a point inboard of the inner surface of the continuous sidewall, thereby creating a concealed region defined by a reentrant angle defined by a lower surface of the cornice and the inner surface of the continuous sidewall proximate the continuous upper edge, a pump coupled to the basin in fluid communication to recirculate liquid to and from the basin and a liquid return conduit having a first end coupled to the pump and a second end coupled to the basin in fluid communication, the liquid return for delivering liquid from the pump to the basin under pressure. The fluid discharge apparatus includes a conduit coupled to the liquid return conduit in fluid communication and further coupled to the basin within the concealed region and extending along a predetermined length of the perimeter in conformance therewith. The conduit may extend either along the entire perimeter of the basin or along a predetermined length of the perimeter of the basin. The conduit includes a plurality of nozzles disposed in spaced apart relation and for communicating liquid therefrom and to the basin in a decorative fashion.

Still further included is a nozzle assembly for receiving and expelling fluid from a fluid source. The nozzle assembly includes a nozzle element and a cap element. The nozzle element includes a continuous sidewall having a continuous outer surface, an open lower end to receive fluid from a fluid source, a conical upper end having a plurality of apertures formed therethrough, a continuous inner surface defining a bore extending from the lower end to the conical upper end to communicate fluid from the open lower to the plurality of apertures and outwardly therefrom, and an element of an engagement pair located intermediate the open lower end and the conical upper end.

The cap element includes a continuous sidewall having a continuous outer surface, an open lower end, a conical upper end having an aperture formed therethrough, a continuous inner surface defining a chamber extending from the open lower end to the aperture and a complemental element of the engagement pair located proximate the open lower end of the cap element. The complemental engagement element of the cap element is detachably and adjustably engagable to the engagement element of the nozzle element to form an auxiliary chamber defined as the area between the continuous inner surface of the conical upper end of the cap element and the continuous outer surface of the conical upper end of the nozzle element, the auxiliary chamber to receive and communicate fluid from the plurality of aperture of the nozzle element and outwardly through the aperture of the cap element, the auxiliary chamber being selectively adjustable upon adjustment of the cap element for varying the volume of the auxiliary chamber for varying the volume of fluid passing through the aperture of the cap element.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 3 is a sectional view taken along line 3—3 of FIG. 1 and further illustrating a pump coupled to the pool structure of FIG. 1 by virtue of a fluid return line;

FIG. 4 is an exploded perspective view of a conduit and a brace of the fountain apparatus of FIG. 1 and shown as it would appear prior to installation, in accordance with a preferred embodiment of the present invention;

FIG. 5 is a fragmented perspective view of the conduit of the fountain apparatus shown in FIG. 4, in accordance with a preferred embodiment of the present invention;

DETAILED DESCRIPTION OF THE PREFERRED EMBODIMENT

The present invention provides, among other things, a pool structure having a fluid discharge apparatus and a fluid discharge apparatus for use in combination with a pool structure such as a swimming pool, wading pool, or other similar structure. In a further and more specific aspect, many swimming pools, wading pools and other similar structures include, among other elements, a basin for holding water. The basin normally includes a continuous upper edge defining a perimeter bounding an opening into the basin within which water resides. The fluid discharge apparatus of the present invention may be coupled proximate the continuous upper edge and may further extend along either the entire perimeter of the continuous upper edge bounding the opening to the basin or alternatively a predetermined length of the perimeter of the basin. In this regard, and as will shown as the detailed discussion ensues, the present invention provides the useful and beneficial features of discharging and displaying water about the perimeter of a pool structure or a predetermined length of a perimeter of a pool structure without fluid discharge apparatus projecting into the opening of the basin of the pool structure. As a result, users may use the pool structure having the fluid discharge apparatus without the risk of being injured.

Figure 1:
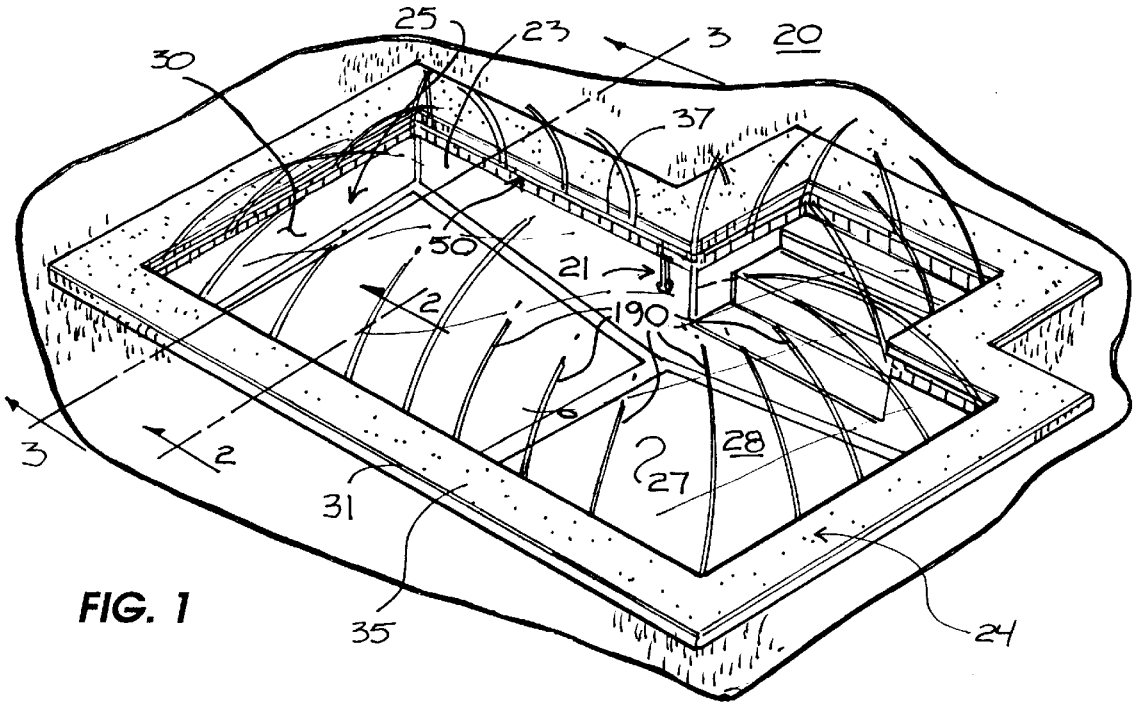
FIG. 1 illustrates a pool structure having a fountain apparatus, in accordance with a preferred embodiment of the present invention.

Turning now to the drawings, in which like reference characters indicate corresponding elements throughout the several views, attention is first directed to FIG. 1 which illustrates a pool structure 20 having a fluid discharge apparatus 21, in accordance with a preferred embodiment of the present invention. With momentary reference to FIG. 3 illustrating a sectional view taken along line 3—3 of FIG. 1, pool structure 20 includes a basin 25 having a continuous sidewall 26 and a closed bottom 27 cooperating together to bound a pool chamber 28 within which water may be retained. Continuous sidewall 26 of basin 25 includes an inner surface 23 and further extends upwardly from closed bottom 27 and terminates with a continuous upper edge 29 defining a perimeter and bounding an opening 30 communicating with pool chamber 28. Basin 25 of pool structure 20 further includes a cornice generally designated at 24. Cornice 24 is generally comprised of deck element 31 carried by continuous upper edge 29 and extending along the entire perimeter of continuous upper edge 29. With additional reference to FIG. 6, deck element 31 includes an upper surface 35, a lower surface 36 residing upon continuous upper edge 29 and extends inwardly into opening 30 and terminates with an endwall 37 at a point inboard of inner surface 23 of the continuous sidewall, thereby creating a concealed region 33 defined by a reentrant angle defined by lower surface 36 of cornice 24 and inner surface 23 of continuous sidewall 26 proximate continuous upper edge 29. Basin 25 is coupled in fluid communication to a pump 38 operative for pumping water to and from basin 25. Pump 38 is coupled to an end 39 of a water return line 40 which extends therefrom and terminates with end 41 coupled to continuous sidewall 26 subjacent continuous upper edge 29. Water return line is in fluid communication with pump 38 and basin 25 and operates to conduct water under pressure from pump 38 to basin 25 after it has been pumped through pump 38.

The foregoing description of pool structure 20 is generally representative of a typical swimming pool, wading pool, or other similar apparatus. Furthermore, like conventional swimming pools and the like, pump 38 is generally representative of a conventional pump filtering system operative for drawing water from basin 25, filtering the water and then pumping the filtered water under pressure back into basin 25 through water return line 40. As shown in FIG. 1, pool structure 20 includes a generally rectangular shape as defined continuous upper edge 29 of basin 25. It will be readily appreciated by those having regard to the art that swimming pools and other varieties of pool structures may be constructed having a variety of perimeter shapes such as rounded, angled, square, rectangular, and the like. As a result, the shape of the perimeter of pool structure 20 as defined by continuous upper edge 29 is not intended to be limiting and is shown merely for the purposes of illustration.

Figure 2:
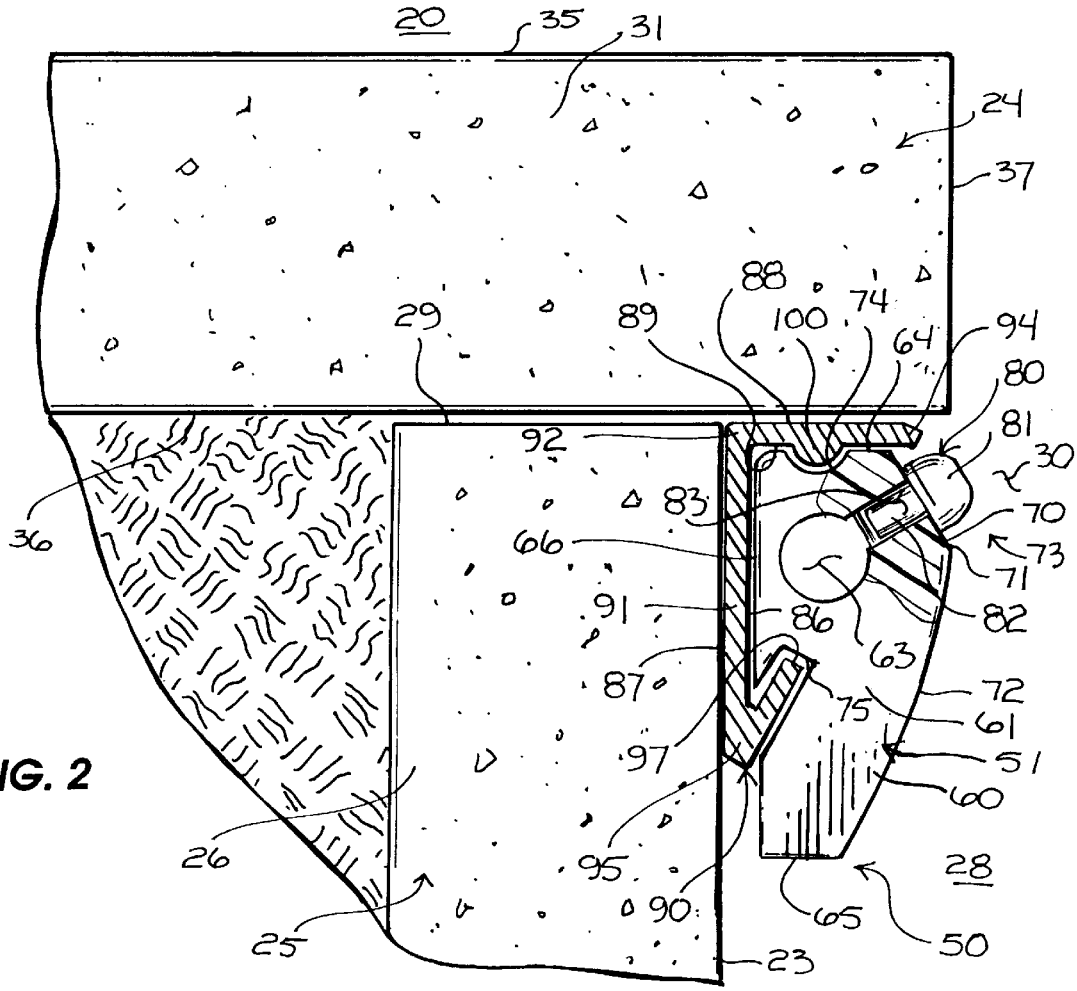
FIG. 2 is a sectional view taken along line 2—2 of FIG. 1.

Regarding the present invention, attention is directed to FIG. 2 which illustrates a sectional view taken along line 2—2 of FIG. 1. Fluid discharge apparatus 21 includes a conduit 50 coupled to basin 25 within concealed region 33. In a further and more specific aspect, in FIG. 3 conduit 50 is shown coupled to lower surface 36 of deck element 31 and resides within concealed region 33, although conduit 50 may be coupled to inner surface 23 of continuous sidewall 26 if desired. Conduit 50 may extend along a predetermined length of the perimeter of pool structure 20, or may be constructed as continuous (FIG. 1) extending along substantially the entire length of the perimeter of basin 25 in conformance therewith as defined by continuous upper edge 29. Conduit 50 is further coupled in fluid communication to end 41 of water return line 40, further details of which will be discussed as the detailed description ensues.

Figure 7:
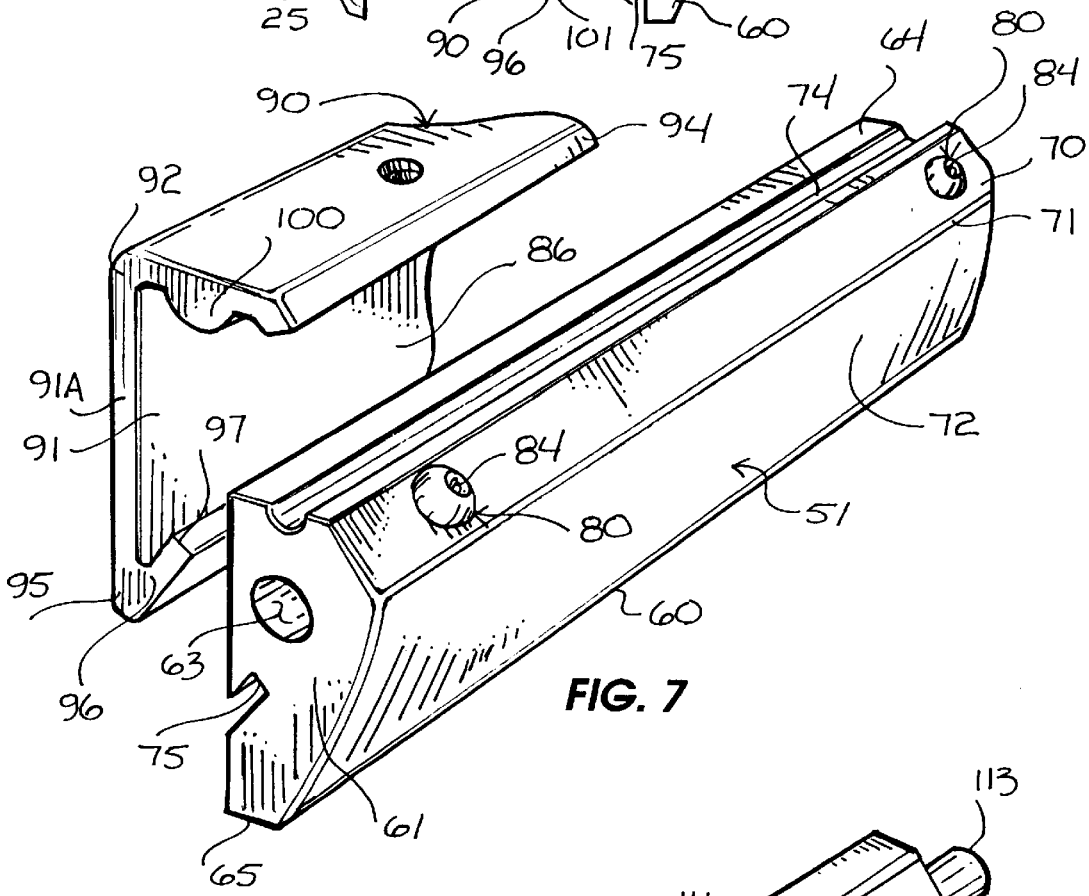
FIG. 7 is an enlarged fragmented perspective view of the brace and the conduit of the fountain apparatus shown in FIG. 4, in accordance with a preferred embodiment of the present invention.
Figure 8:
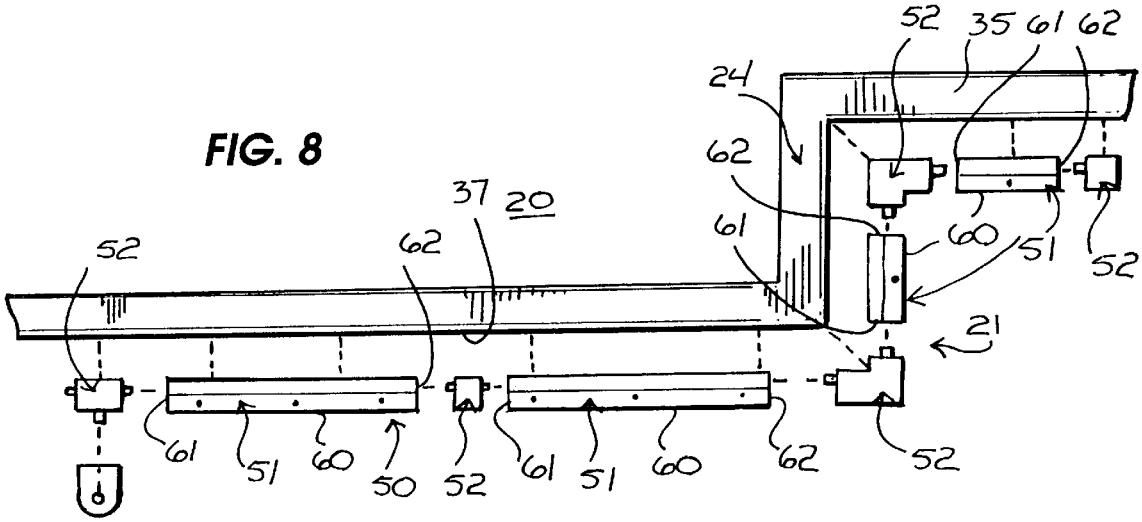
FIG. 8 is a fragmented top plan view of the pool of FIG. 1 with the fountain apparatus shown as it would appear prior to installation, in accordance with a preferred embodiment of the present invention.

With attention directed to FIG. 8, conduit 50 is generally comprised of a plurality of conduit segments 51 intercoupled in fluid communication by a plurality of connectors 52. With reference to FIG. 4, FIG. 5 and FIG. 7, preferably constructed of plastic or other similar material, each conduit segment 51 includes a body 60 having a first end 61, a second end 62 (shown only in FIG. 4), a bore 63 extending longitudinally therethrough from first end 61 to second end 62, an upper end 64, a lower end 65 and a rear surface 66 (shown in FIG. 2). Body 60 further includes a first front surface 70 extending outwardly and downwardly from upper end 64 and terminating with a front edge 71 extending longitudinally along substantially the entire length of body 60, and a corresponding second front surface 72 extending downwardly and inwardly from front edge 71 and terminating at lower end 65. A recess or channel 74 is also present formed into upper end 64 of body 60 and extends along substantially the entire length thereof from first end 61 to second end 62. Furthermore, another recess or channel 75 is also present intermediate upper end 64 and lower end 65 and extends inwardly and upwardly from rear surface 66 of body 60 and further extends along substantially the entire length thereof from first end 61 to second end 62. Body 60 of each conduit segment 51 includes a generally elongate configuration and may be constructed of varying sizes and lengths depending upon the needs of the user and depending upon the configuration of the perimeter of pool structure 20 as defined by continuous upper edge 29, further details of which will be discussed as the detailed description ensues.

Each conduit segment 51 carries one or more of a plurality of nozzles 80 disposed in spaced apart relation along first front surface 70, each of which are coupled to body 60 in fluid communication with bore 63. More clearly shown in FIG. 3, each nozzle 80 includes a head 81 with a nozzle body 82 extending outwardly therefrom carried with a bore 83 extending inwardly from first front surface 70 to bore 63. The nozzle body 82 of each nozzle 80 may be either fixedly engaged to bore 83 or detachably engaged to bore 83 by virtue of threaded engagement or the like, although this is not essential. A bore 84 (FIG. 5 and FIG. 7) extends through nozzle body 82 and head 81 operative for communicating water from bore 63 and outwardly therefrom as will be discussed more fully as the description ensues.

With attention directed to FIG. 2, FIG. 4, FIG. 6 and FIG. 7, each conduit segment 51 may be coupled proximate continuous upper edge 29 of basin 25 by virtue of a brace 90. Preferably constructed of plastic or other similarly flexibly rigid substance, brace 90 is elongate an includes an upstanding sidewall 91 having an inner surface 86, an outer surface 87 (FIG. 2), a first end 91A, a second end 92A (FIG. 4) and an upper end 92 with an upper flange element 93 extending laterally outwardly therefrom and terminating with an outer end 94 at a point inboard of inner surface 86 of upstanding sidewall 91. Upstanding sidewall 91 further includes a lower end 95 having an outwardly and upwardly extending lower flange element 96 terminating with an outer end 97 at a point inboard of inner surface 86 of upstanding sidewall 91. Upper flange element 93 further includes an upper surface 88 and a lower surface 89 having a molded aspect extending downwardly therefrom and defined as an inwardly extending rib 100 extending longitudinally along substantially the entire length of upper flange element 93.

Figure 6:
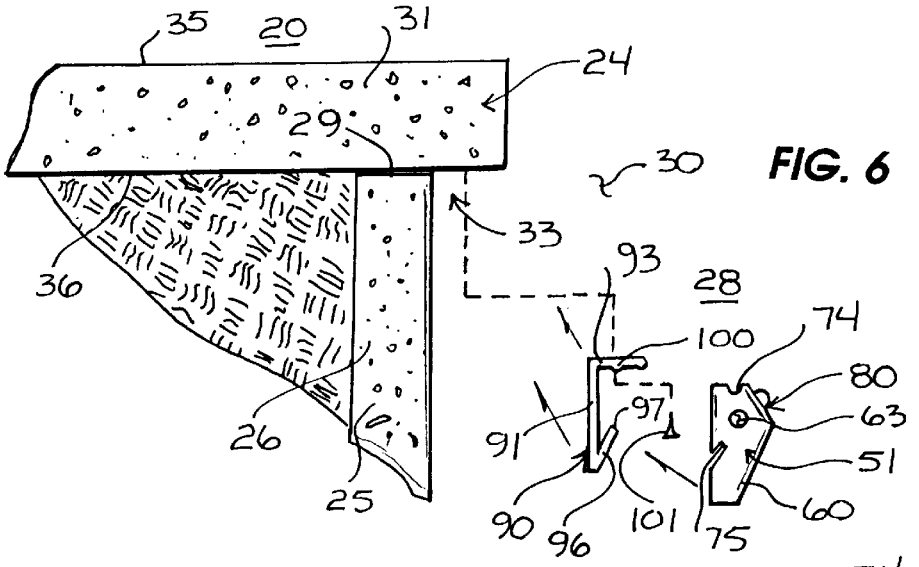
FIG. 6 is a view somewhat similar to the view of FIG. 4, and showing a portion of the fountain apparatus as it would appear prior to installation, in accordance with a preferred embodiment of the present invention.

With continuing reference to FIG. 4 and additional reference to FIG. 6, to couple each conduit segment 51 proximate continuous upper edge 29 of basin 25, brace 90 may be engaged to basin 25 within concealed region 33 with upstanding sidewall 91 positioned proximate continuous sidewall 26 and upper flange element 93 positioned proximate deck element 31 adjacent lower surface 36. In this manner, brace 90 may then be engaged, either fixedly or detachably, to basin 25. Regarding the preferred embodiment, brace may be secured or coupled to basin 25 within concealed region 33 by virtue of fasteners 101 received through apertures 102 formed through upper flange element 93, fasteners 101 for fastening brace 90 to lower surface 36 of cornice 24. Fasteners 101 may be screws, rivets or the like operative for fastening brace 90 to lower surface 36 of deck element 31.

Although brace 90 has been herein disclosed as securable to lower surface 36 of deck element 31, it will be readily understood that brace 90 may alternatively be fastened to inner surface 23 of continuous sidewall 26 by virtue of fasteners 101. Furthermore, although fasteners 101 have been disclosed as the preferred means for coupling brace 90 to basin 25 within concealed region 33, it will be understood that other fastening means may be used such as a suitable adhesive, epoxy resin, a selected and suitable mortar and the like.

Once brace 90 is installed, conduit segment 51 may be easily inserted or installed within brace 90 with lower flange element 96 received into channel 75 and rib 100 received into channel 74 as clearly shown in FIG. 2. Upon installation, body 60 is substantially concealed within concealed region 33 immediately subjacent cornice 24. In this manner, each nozzle 80 extends somewhat beyond endwall 37 immediately subjacent lower surface 36 of deck element 31 of cornice 24 and is angled upwardly and outwardly toward opening 30 defined by continuous upper edge 29.

With attention directed back to FIG. 8, a plurality of conduit segments 51 may be coupled together in fluid communication about substantially the entire perimeter of pool structure 20 by virtue of connectors 52. Depending upon the configuration of the perimeter of pool structure 20, each connector 52 may be provided in a variety of shapes and configurations operative to conform conduit 50 to the shape of either the entire perimeter of pool structure 20 or the entire perimeter of pool structure 20 as defined by continuous upper edge 29.

Figure 9:
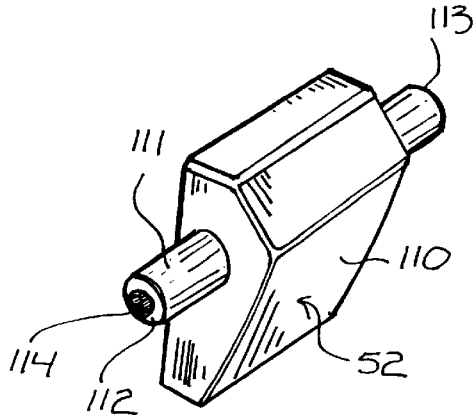
FIG. 9 is a perspective view of a connector of the fountain apparatus, in accordance with a preferred embodiment of the present invention.

Accordingly, with attention directed to FIG. 9, shown is a connector 52 including a body 110 having the same general cross sectional shape as body 60 of each conduit segment 51 herein previously discussed. Preferably constructed of plastic or other similar material, body 110 of connector 52 includes a connector conduit 111 passing therethrough and having opposing ends 112 and 113 extending outwardly from either side of body 111 with a bore 114 extending therethrough. Ends 112 and 113 of connector conduit 111 are each sized to be sealingly received within the bore 63 of opposing conduit segments 51, respectively. In this manner, a pair of conduit segments 51 may be coupled together in fluid communication with one another by virtue of connector 52. Regarding the configuration of connector 52 shown in FIG. 9, a pair of conduit segments 51 would be intercoupled in a substantially horizontal or linear fashion for intercoupling the conduit segments 51 along a straight portion of the perimeter of pool structure 20.

Figure 10:
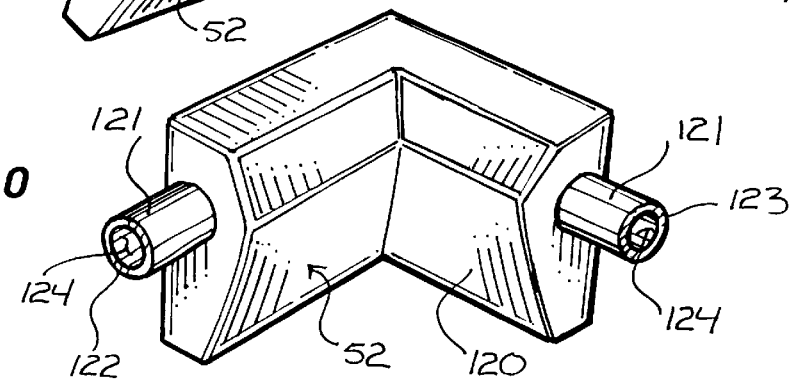
FIG. 10 is a perspective view of another connector of the fountain apparatus, in accordance with a preferred embodiment of the present invention.

Additionally, and with attention directed to FIG. 10, connector 52 may also be formed having a body 120 shaped for receipt within a corner of the perimeter of pool structure 20 as defined by continuous upper edge 29. In this regard, body 120 of connector 52 shown in FIG. 10 is formed in the shape of a right angle with a connector conduit 121 extending therethrough and terminating with opposing ends 122 and 123 extending outwardly therefrom and disposed at a right angle relative each other in conformance with the shape of body 120 and defining a bore 124 communicating through body 120. Like connector 52 discussed in combination with FIG. 9, ends 122 and 123 of connector conduit 121 are each sized to be sealingly received within the bore 63 of opposing conduit segments 51, respectively. In this manner, a pair of conduit segments 51 may be coupled together in angled relation and in fluid communication with one another by virtue of connector 52. Regarding the configuration of connector 52 shown in FIG. 10, a pair of conduit segments 51 would be intercoupled in an inwardly angled fashion for intercoupling the conduit segments 51 along an inner corner of the perimeter of pool structure 20.

Figure 11:
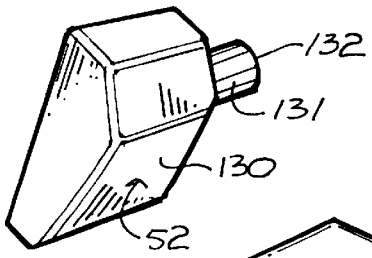
FIG. 11 is a perspective view of yet another connector of the fountain apparatus, in accordance with a preferred embodiment of the present invention.

Furthermore, and with attention directed to FIG. 11, connector 52 may be constructed having a body 130 with a connector conduit 131 extending outwardly from only one end thereof. In this fashion, and consistent with the foregoing discussion, end 132 of connector conduit 131 may be received into bore 63 of an individual conduit segment 51 to terminate the length of conduit 50, thus allowing a user form conduit 50 of varying predetermined and selected lengths along the perimeter of pool structure. In this regard, connector 52 shown in FIG. 11 is operative as a plug for sealing the end of conduit 50 as desired.

Figure 12:
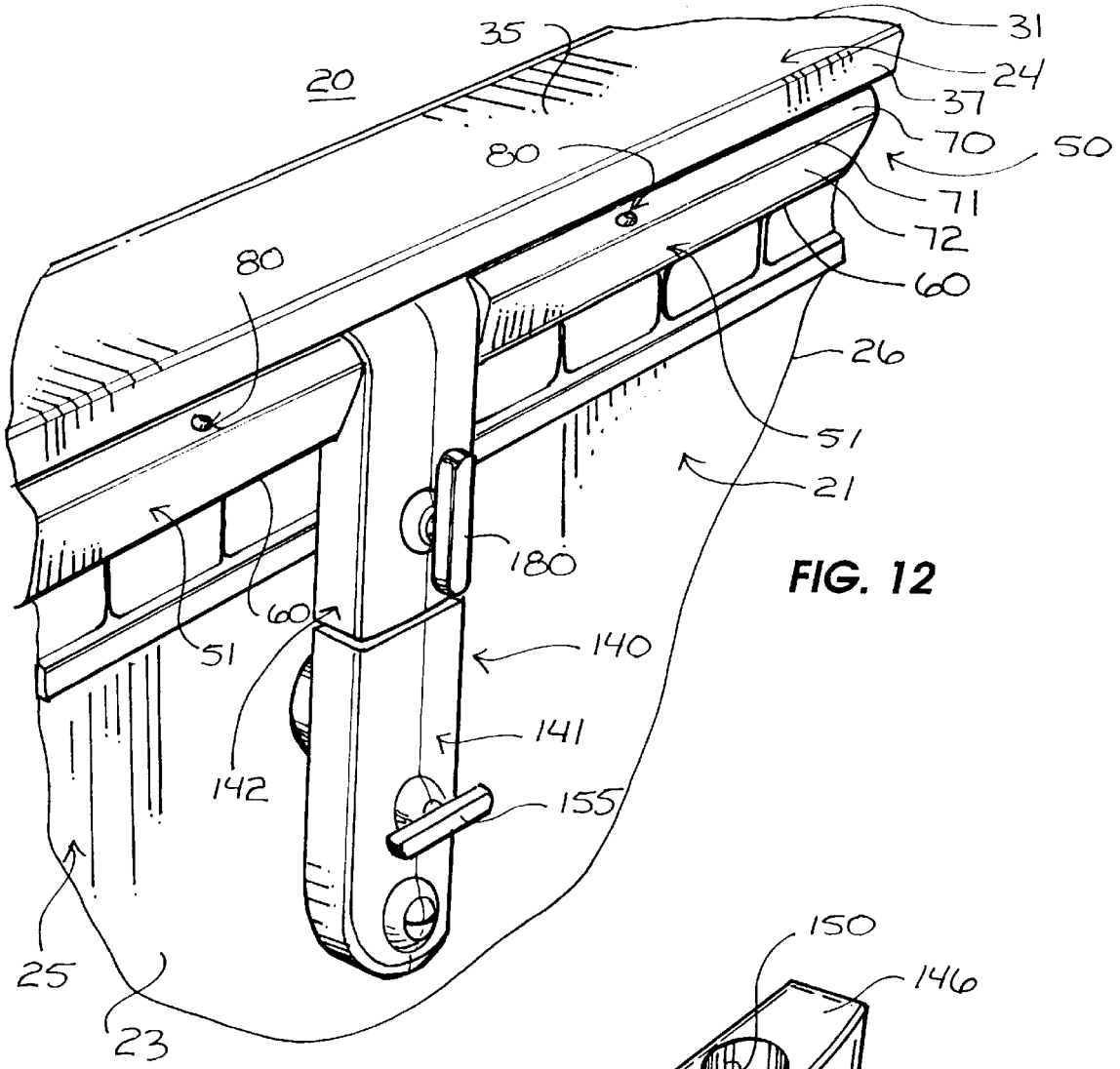
FIG. 12 is a fragmented perspective view of the fountain apparatus shown as it would appear installed in a pool structure, and further illustrating a conduit assembly intercoupling the fountain apparatus to a fluid supply, in accordance with a preferred embodiment of the present invention.
Figure 13:
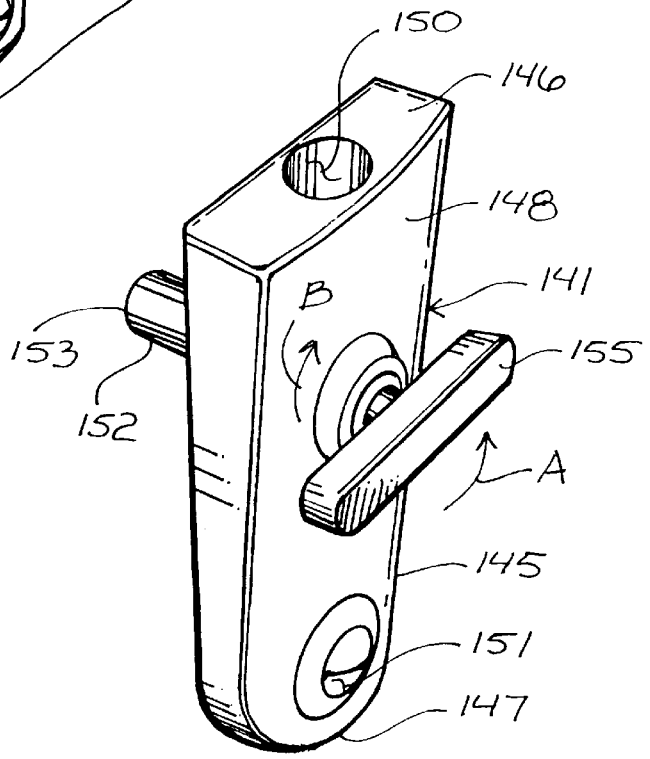
FIG. 13 is a perspective view of a first conduit element of the conduit assembly of FIG. 12, in accordance with a preferred embodiment of the present invention.

As herein previously discussed, conduit 50 is engagable to end 41 of water return line 40 in fluid communication for conducting water supplied from pump 38 into and through conduit 50. With attention directed to FIG. 12, to connect conduit 50 to water return line 40, provided is a conduit assembly 140 including a first conduit element 141 and a second conduit element 142. With momentary reference to FIG. 13, first conduit element 141 includes a body 145 having a generally elongate configuration, an upper end 146, a lower end 147, a front surface 148 and an opposing rear surface (not shown). Preferably constructed plastic or other similar material, first conduit element 141 further includes a first bore 150 extending into body 145 from upper end 146 and downwardly therefrom proximate lower end 147. First bore 150 intersects a second bore 151 extending through front surface 143, into body 145 and outwardly therefrom through a connector conduit 152 terminating with an outer end 153. A valve handle 155 is present intermediate upper end 146 and lower end 147 and is operative for actuating a valve assembly housed within body 145. Although not herein specifically shown, the valve assembly housed within body 145 is of a conventional variety which may be actuated by virtue of turning valve handle 155 in a predetermined direction either counterclockwise indicated by the arcuate arrowed line A or the clockwise direction indicated by the arrowed line B, further details of which will be discussed shortly.

Figure 14:
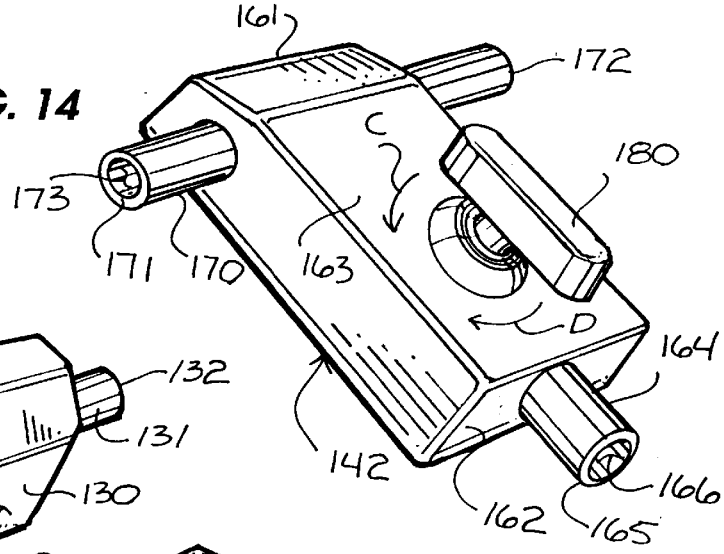
FIG. 14 is a perspective view of a second conduit element of the conduit assembly of FIG. 12, in accordance with a preferred embodiment of the present invention.

With attention directed to FIG. 14, second conduit element 142 includes a body 160 having a generally elongate configuration, an upper end 161, a lower end 162, a front surface 163 and an opposing rear surface (not shown). Preferably constructed plastic or other similar material, second conduit element 142 further includes a connector conduit 164 extending outwardly from lower end 162 and terminating with an outer end 165. Connector conduit 164 defines a first bore 166 extending inwardly therefrom into body 160 proximate upper end 161. Body 160 also includes a connector conduit 170 passing laterally therethrough and having opposing ends 171 and 172 extending outwardly from either side of body 160. Connector conduit 170 defines a second bore 173 extending therethrough which intersects first bore 166 proximate upper end 161. A valve handle 180 is present intermediate upper end 161 and lower end 162 and is operative for actuating a valve assembly housed within body 160. Although not herein specifically shown, the valve assembly housed within body 160 is of a conventional variety which may be actuated by virtue of turning valve handle 180 in a predetermined direction either counterclockwise indicated by the arcuate arrowed line C or the clockwise direction indicated by the arrowed line D, further details of which will be discussed shortly.

To interconnect conduit 50 to end 41 of water return line 40, outer end 153 of connector conduit 152 of first conduit element 141 may be inserted into end 41 of water return line 40 (not shown) with upper end 146 of body 145 extending upwardly therefrom adjacent continuous sidewall 26. End 153 of connector conduit 152 is specifically sized to be sealingly received within the bore (not shown) of end 41 of water return line 40. End 165 of connector conduit 164 may then be inserted into first bore 150 of first conduit element 141 with lower end 162 of second conduit element 142 residing adjacent upper end 146 of first conduit element 141 and upper end 161 of second conduit element 142 extending upwardly proximate continuous upper edge 29 of basin 25. Consistent with the present discussion, end 165 of connector conduit 164 is specifically sized to be sealingly received within first bore 150. Once conduit assembly 140 is assembled in this fashion, ends 171 and 172, respectively, may be inserted within the bore 63 of a pair of opposing conduit segments 51 of conduit 50 extending along continuous upper edge 29 of basin 25 thus interconnecting conduit 50 to water return line 40 in fluid communication. Furthermore, ends 171 and 172 of connector conduit 170 are sized to be sealingly received with each respective bore 63 of each conduit segment 51.

In operation, water supplied from pump 38 is pumped through water return line 40 and channeled through conduit assembly 140 for receipt into conduit 50. Water then travels through conduit 50 via each respective bore 63 of each conduit segment 51 and through the connector conduits of each respective connector 52. As the water pressure builds within conduit 50, the water is expelled through the nozzles upwardly and outwardly in the form of streams 190 above opening 30 for ultimate receipt into pool chamber 28 of basin 25 as shown in FIG. 1 and FIG. 3. In this manner, fluid discharge apparatus 21 operates to receive water from pump 38 and expel the water into the basin 25 in a pleasing and decorative fashion. Furthermore, a user may interconnect any number of conduit segments 51 via one or more connectors for extending conduit 50 along a predetermined length of the perimeter of pool structure 20 as defined by continuous upper edge 29 of basin 25, or may alternatively construct conduit 50 as continuous about the entire perimeter of pool structure 20 as evidenced in FIG. 1, thus contributing to the versatility of fluid discharge apparatus 21. Furthermore, because conduit 50 is substantially concealed from opening 30 within the juncture defined by the intersection continuous sidewall 26 and deck element 31, and does include protruding mechanical elements obstructing opening 30, users may safely swim and play about pool structure 20 without risking injury from fluid discharge apparatus 21. As a result, fluid discharge apparatus 21 may be used for expelling water in the decorative fashion shown in FIG. 1 and FIG. 3 even when users which to swim or play in pool structure 20.

In furtherance of the versatility of fluid discharge apparatus 21, valve handles 155 and 180 may be used for selectively activating or deactivating fluid discharge apparatus 21. In particular, and with attention directed to FIG. 12, each valve handle 155 and 180 may be turned to either an open position or a closed position. In the open position, water supplied from pump 38 is channeled through conduit assembly 140 for receipt into conduit 50 and outwardly from nozzles 80 in the manner as shown in FIG. 1. However, handles 155 and 180 may alternatively be rotated to the closed position operative for closing first bore 150 of first conduit element 141 and first bore 166 of second conduit element 142. Furthermore, when valve handle 155 is in the closed position, water is received and channeled into and through second bore 151 for direct receipt into pool chamber 28 of basin 25, second bore 151 being operative as an outlet for conducting water directly into basin 25. In this manner, fluid discharge apparatus 21 may be easily and efficiently activated or deactivated depending upon the needs of the user without the necessity of disassembling, in whole or in part, the fluid discharge apparatus 21.

Figures 15, 16, 17, 18:
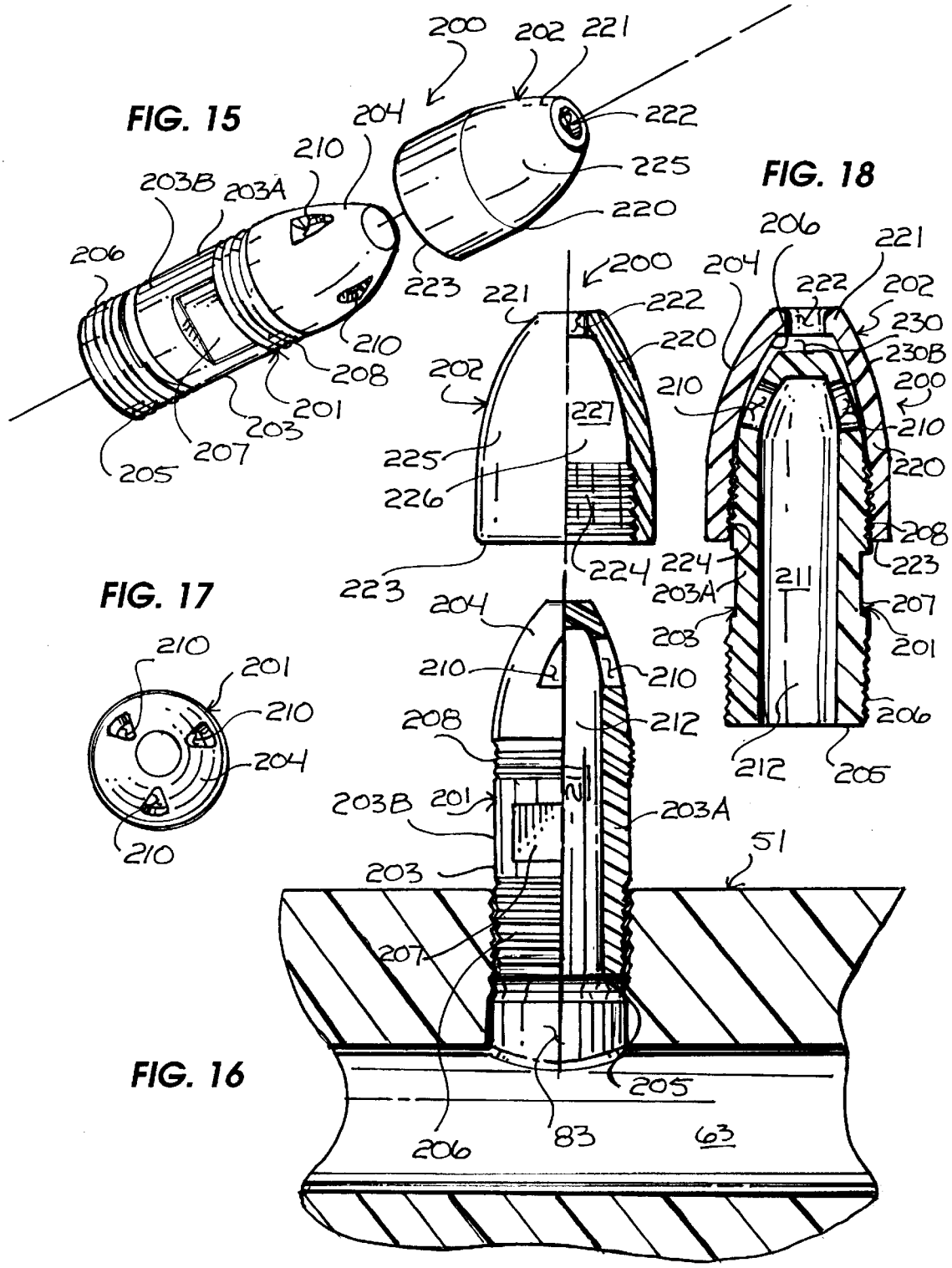
FIG. 15 is an exploded perspective view of a nozzle assembly including a nozzle element and a cap element, in accordance with a preferred embodiment of the present invention.
FIG. 16 is a side elevational view of the nozzle assembly of FIG. 15 shown as it would appear assembled and coupled to a fluid source, with portions therein broken away for the purpose of illustration, in accordance with a preferred embodiment of the present invention.
FIG. 17 is a top plan view of the nozzle element of FIG. 15, in accordance with a preferred embodiment of the present invention.
FIG. 18 is a side elevational view of the nozzle assembly of FIG. 15 shown as it would appear assembled.

With attention directed to FIG. 15, illustrated an exploded perspective view of a nozzle assembly 200 including a nozzle element 201 and a cap element 202. Nozzle assembly 200 may be used in combination with fountain apparatus in lieu or in combination with one or more nozzles 80 previously discussed. In any event, and with additional reference to FIG. 16, nozzle element 201 includes a body 203 formed generally in the shape of a bullet and defined by a continuous sidewall 203A having a continuous outer surface 203B, a conical upper end 204, a lower end 205 having an outwardly threaded aspect 206 operative for threaded engagement to a bore 83 of a selected conduit segment 51 as shown in FIG. 16. Body 203 further includes a recess 207 intermediate conical upper end 204 and lower end 205 which may be grasp by a wrench or other similar tool and rotated in a predetermined direction for either threadably engaging outwardly threaded aspect 206 to bore 100 or threadably detaching threaded aspect 206 from bore 100, although this is not essential. An outwardly threaded aspect 208 is also provided intermediate conical upper end 204 and recess 207. With momentary reference to FIG. 17 illustrating a top plan view of nozzle element 201, a plurality of apertures 210 are formed through conical upper end 204 and are further provided in spaced-apart relation. Although three apertures 210 are shown, it will be readily appreciated that more or less may be used. Continuous sidewall 203A of body 203 further includes a continuous inner surface 212 which defines a bore 211 extending therethrough from lower end 205 to conical upper end 204.

Cap element 202 includes a continuous sidewall 220 having a conical shape corresponding to conical upper end 204. Continuous sidewall includes an upper end 221 having an aperture 222 extending therethrough, a lower end 223 having an inner threaded aspect 224, a continuous outer surface 225 and a continuous inner surface 226 bounding a chamber 227. As shown in FIG. 18, inner threaded aspect 224 of cap element 202 is threadably and detachably engagable to outwardly threaded aspect 206 of nozzle element 201 upon rotation of cap element 202 in a predetermined direction, thus forming an auxiliary chamber 230 defined as the area between continuous inner surface 226 of upper end 221 of cap element 202 and continuous outer surface 203B of conical upper end 204. As a result, water entering lower end 205 of nozzle element 201 travels through bore 211, outwardly through apertures 210, into auxiliary chamber 230 and outwardly through aperture 222 in the form of a stream of water.

Nozzle assembly 200 may be selectively adjusted for varying the height of the stream of water conducted through aperture 222. In particular, the volume of auxiliary chamber 230 may be decreased upon rotation of cap element 202 in a predetermined direction thus lowering the volume of fluid or water passing through auxiliary chamber 230 from apertures 210 and outwardly through aperture 222. Furthermore, cap element 202 may further be rotated in a predetermined direction for engaging continuous inner surface 226 of cap element 202 to continuous outer surface 203B of conical upper end 204 thus sealing apertures 210 and preventing fluid or water from passing through apertures 210 and outwardly through aperture 222. Additionally, the volume of auxiliary chamber 230 may alternatively be increased upon rotation of cap element 202 in a predetermined direction thus increasing the volume of fluid or water passing through auxiliary chamber 230 from apertures 210 and outwardly through aperture 222.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A fluid discharge apparatus for use with a pool structure of a type having a basin including a continuous sidewall and a closed bottom cooperating together to bound a chamber, said continuous sidewall having an inner surface extending away from said closed bottom and terminating with a continuous upper edge defining a perimeter bounding an opening to said chamber, and a cornice extending inwardly into said opening proximate said continuous upper edge and terminating with an endwall at a point inboard of said inner surface of said continuous sidewall creating a concealed region defined by a reentrant angle defined by a lower surface of said cornice and said inner surface of said continuous sidewall proximate said continuous upper edge, a pump coupled to said basin in fluid communication to recirculate liquid to and from said basin and a liquid return conduit having a first end coupled to said pump and a second end coupled to said basin in fluid communication, said liquid return for delivering liquid from said pump to said basin under pressure, said fluid discharge apparatus coupled to said liquid return conduit in fluid communication and further coupled to said basin within said concealed region and extending along a predetermined length of said perimeter in substantial conformance therewith, said fluid discharge apparatus comprising:

a plurality of braces engagable to said basin within said concealed region, each one of said plurality of braces including:

an elongate body having an inner surface, an upper flange element extending outwardly from said elongate body to a point inboard of said inner surface of said elongate body, said upper flange element having an aspect extending outwardly therefrom, and a lower flange element spaced from said upper flange element and extending upwardly and outwardly from said elongate body to a point inboard of said inner surface of said elongate body, a plurality of conduit segments, each one of said plurality of conduit segments including a body having a first end, a second end, a bore extending therethrough from said first end to said second end, a front surface, a first recess, a spaced-apart second recess and at least one nozzle extending therethrough said front surface in fluid communication with said bore, said aspect being detachably engagable with said first recess and said second flange element being detachably engagable with said second recess; and a plurality of connectors for interconnecting said plurality of conduit segments in series, in fluid communication and in substantial conformance with a predetermined length of said perimeter of said basin.

2. The fluid discharge apparatus of claim 1, further including a conduit assembly intercoupling said fluid discharge apparatus to said liquid return in fluid communication.

3. The fluid discharge apparatus of claim 2, wherein said conduit assembly includes a valve, said valve being movable between an open position for conducting liquid from said liquid return conduit to said fluid discharge apparatus and a closed position for conducting liquid away from said fluid discharge apparatus and through an outlet of said conduit assembly for receipt into said basin.

4. The fluid discharge apparatus of claim 1, wherein each one of said plurality of connectors includes:

a body; and a connector conduit extending through said body and having opposed ends each sized for sealing engagement to a bore of a respective conduit segment.

5. A pool structure, comprising:

a basin including a continuous sidewall and a closed bottom cooperating together to bound a chamber, said continuous sidewall having an inner surface extending upwardly from said closed bottom and terminating with a continuous upper edge defining a perimeter bounding an opening to said chamber, and a cornice extending inwardly into said opening proximate said continuous upper edge and terminating with an endwall at a point inboard of said inner surface of said continuous sidewall creating a concealed region defined by a reentrant angle defined by a lower surface of said cornice and said inner surface of said continuous sidewall proximate said continuous upper edge;

a pump coupled to said basin in fluid communication to recirculate liquid to and from said basin;

a liquid return conduit having a first end coupled to said pump and a second end coupled to said basin in fluid communication, said liquid return for delivering liquid from said pump to said basin under pressure;

a fluid discharge apparatus coupled to said liquid return conduit in fluid communication and further coupled to said basin within said concealed region and extending along a predetermined length of said perimeter in substantial conformance therewith, said fluid discharge apparatus for communicating liquid to said basin in a decorative fashion, said fluid discharge apparatus comprising;

a brace engagable to said basin within said concealed region, said brace including an elongate body having an inner surface, an upper flange element extending outwardly therefrom to a point inboard of said inner surface of said elongate body, said upper flange element including an aspect extending outwardly therefrom, and a lower flange element spaced from the upper flange element and extending upwardly and outwardly therefrom said elongate body to a point inboard of said inner surface of said elongate body, and a conduit segment including a body having a first end, a second end, a bore extending therethrough from said first end to said second end, a front surface, a first recess, a spaced apart second recess and at least one nozzle extending therethrough said front surface in fluid communication with said bore, said aspect being detachably engagable with said first recess and said second flange element being detachably engagable with said second recess.

6. The pool structure of claim 5, further including a conduit assembly intercoupling said fluid discharge apparatus to said liquid return in fluid communication.

7. The pool structure of claim 6, wherein said conduit assembly includes a valve, said valve being movable between an open position for conducting liquid from said liquid return conduit to said fluid discharge apparatus and a closed position for conducting liquid away from said fluid discharge apparatus and through an outlet of said conduit assembly for receipt into said basin.

8. A fluid discharge apparatus for use with a pool structure of a type having a basin including a continuous sidewall and a closed bottom cooperating together to bound a chamber, said continuous sidewall having an inner surface extending upwardly from said closed bottom and terminating with a continuous upper edge defining a perimeter bounding an opening to said chamber, and a cornice extending inwardly into said opening proximate said continuous upper edge and terminating with an endwall at a point inboard of said inner surface of said continuous sidewall creating a concealed region defined by a reentrant angle defined by a lower surface of said cornice and said inner surface of said continuous sidewall proximate said continuous upper edge, a pump coupled to said basin in fluid communication to recirculate liquid to and from said basin and a liquid return conduit having a first end coupled to said pump and a second end coupled to said basin in fluid communication, said liquid return for delivering liquid from said pump to said basin under pressure, said fluid discharge apparatus coupled to said liquid return conduit in fluid communication and further coupled to said basin within said concealed region and extending along a predetermined length of said perimeter in substantial conformance therewith, said fluid discharge apparatus comprising:

at least one conduit segment including a body having a first end, a second end, a bore extending therethrough from said first end to said second end, a front surface, at least one nozzle extending through said front surface in fluid communication with said bore and an engagement assembly carried by said body spaced from said nozzle, wherein the engagement assembly includes a first recess formed into said body of said conduit segment and a second spaced-apart recess formed into said body of said conduit segment; and at least one elongate body engagable with said basin within said concealed region, said elongate body having a complemental engagement assembly detachably engagable with said engagement assembly of said conduit segment, wherein the complemental engagement assembly includes, an upper flange element extending outwardly from said elongate body to a point inboard of an inner surface of said elongate body, said upper flange element including an aspect extending outwardly therefrom, and a lower flange element extending upwardly and outwardly from said elongate body to a point inboard of said inner surface of said elongate body in spaced relation from said upper flange element, said aspect of said first flange element detachably engagable with said first recess of said conduit segment and said second flange element detachably engagable with said second recess of said conduit segment.

9. The fluid discharge apparatus of claim 8, further including a conduit assembly intercoupling said conduit to said liquid return in fluid communication.

10. The fluid discharge apparatus of claim 9, wherein said conduit assembly includes a valve, said valve being movable between an open position for conducting liquid from said liquid return conduit to said conduit and a closed position for conducting liquid away from said conduit and through an outlet of said conduit assembly for receipt into said basin.

* * * * *